US012584698B2

(12) United States Patent
Chen et al.

(10) Patent No.: US 12,584,698 B2
(45) Date of Patent: Mar. 24, 2026

(54) ONE-PIECE FORMED METAL HEAT DISSIPATION PLATE AND HEAT DISSIPATION DEVICE HAVING SAME

(71) Applicants: Kuei-Fang Chen, Toufen City (TW); Shyi-Yuan Chen, Diamond Bar, CA (US)

(72) Inventors: Kuei-Fang Chen, Toufen City (TW); Shyi-Yuan Chen, Diamond Bar, CA (US)

( * ) Notice: Subject to any disclaimer, the term of this patent is extended or adjusted under 35 U.S.C. 154(b) by 239 days.

(21) Appl. No.: 18/209,520

(22) Filed: Jun. 14, 2023

(65) Prior Publication Data

US 2023/0375286 A1 Nov. 23, 2023

Related U.S. Application Data

(63) Continuation of application No. PCT/IB2021/060226, filed on Nov. 4, 2021.

(30) Foreign Application Priority Data

Aug. 6, 2021 (TW) ..... 110129196

(51) Int. Cl.
*F28F 3/04* (2006.01)
*F28F 13/14* (2006.01)

(52) U.S. Cl.
CPC ..... *F28F 3/04* (2013.01); *F28F 13/14* (2013.01); *F28F 2215/04* (2013.01); *F28F 2215/10* (2013.01)

(58) Field of Classification Search
CPC ..... F28F 2215/10; F28F 2215/04; F28F 3/04; F28F 13/14
See application file for complete search history.

(56) References Cited

U.S. PATENT DOCUMENTS 1,887,036 A * 11/1932 Modine ..... F28F 1/32 165/181
5,353,867 A * 10/1994 Jaspers ..... H01L 23/467 257/E23.099

(Continued)

FOREIGN PATENT DOCUMENTS

CN 101820735 A 9/2010
CN 204268430 U 4/2015

(Continued)

OTHER PUBLICATIONS

Translation of JP2002093961A named Translation-JP2002093961A (Year: 2002).*

(Continued)

*Primary Examiner* — Paul Alvare
(74) *Attorney, Agent, or Firm* — Rivka Friedman

(57) ABSTRACT

A one-piece formed metal heat dissipation plate includes a substrate and multiple heat dissipation strips arranged in a longitudinal direction. The substrate includes a first surface and a second surface arranged opposite to each other. Each of the heat dissipation strips includes two connection ends connected to the first surface, at least two ridge portions arranged between the two connection ends, and multiple concave-convex tooth portions formed on at least one side of at least one of the ridge portions. A cut slot is defined in the substrate corresponding to the at least two ridge portions of each heat dissipation strip, and the cut slot penetrates the first surface and the second surface.

8 Claims, 14 Drawing Sheets

(56) References Cited

U.S. PATENT DOCUMENTS

| | | | | |
|---|---|---|---|---|
| 5,653,285 | A | 8/1997 | Lee | |
| 6,098,279 | A * | 8/2000 | Lee | H01L 23/3672 257/713 |
| 6,273,183 | B1 * | 8/2001 | So | F28D 1/0333 165/152 |
| 6,453,987 | B1 * | 9/2002 | Cheng | H01L 23/3672 257/722 |
| 2007/0053168 | A1 * | 3/2007 | Sayir | H01L 23/367 257/E23.105 |
| 2010/0206538 | A1 * | 8/2010 | Chen | H01L 23/467 165/185 |
| 2013/0045411 | A1 * | 2/2013 | Bauer | F28F 3/025 429/120 |
| 2014/0345834 | A1 | 11/2014 | Dunn et al. | |
| 2015/0189791 | A1 * | 7/2015 | Tamura | B23P 15/26 29/890.035 |
| 2015/0276330 | A1 * | 10/2015 | Rigaudie | F28F 3/027 165/185 |
| 2016/0305721 | A1 * | 10/2016 | Yeh | F28F 3/02 |
| 2021/0239310 | A1 * | 8/2021 | Zhou | H01L 23/467 |
| 2022/0065556 | A1 * | 3/2022 | Agata | F28F 17/005 |

FOREIGN PATENT DOCUMENTS

| | | | | |
|---|---|---|---|---|
| CN | 212910510 | U | 4/2021 | |
| JP | 2002093961 | A * | 3/2002 | |
| JP | 2004014608 | A | 1/2004 | |
| JP | 2005051232 | A | 2/2005 | |
| JP | 3199829 | U | 9/2015 | |
| TW | 200706822 | A | 2/2007 | |
| WO | WO-2013025130 | A1 * | 2/2013 | F21V 29/75 |

OTHER PUBLICATIONS

Translation of WO2013025130A1 named Translation-WO2013025130A1 (Year: 2013).*

Zhu et al. "Nature-Inspired Structures Applied in Heat Transfer Enhancement and Drag Reduction" pp. 1-23. Micromachines 2021, 12, 656. Online. Jun. 3, 2021; [retrieved Jan. 8, 2022].

Japanese Patent Allowance in JP2024-500573 mailed on Feb. 18, 2020.

Taiwanese Office Action for TW 110129196 mailed on Jun. 10, 2022.

International Search Report for PCT/IB2021/060226 mailed on Feb. 3, 2022.

European Search Report Dated May 27, 2025 From the EPO Re. Application No. 21952674.6.

* cited by examiner

ONE-PIECE FORMED METAL HEAT DISSIPATION PLATE AND HEAT DISSIPATION DEVICE HAVING SAME

CROSS REFERENCE TO RELATED APPLICATIONS

This application is continuation-in-part of PCT/IB2021/060226, filed Nov. 4, 2021, which claims priority to Taiwan Patent Application No. 110129196, filed Aug. 6, 2021, both of which are hereby incorporated herein by reference.

FIELD OF DISCLOSURE

The present invention provides a heat dissipation structure. The heat dissipation structure particularly refers to a one-piece formed metal heat dissipation plate and a heat dissipation device using the same, in which more ridge portions are formed in a same unit area to improve heat dissipation.

DESCRIPTION OF RELATED ART

In order to quickly remove heat generated by a heat dissipation source, conventional heat dissipation structures comprise components such as water coolers, heat pipes, fans, or fins. However, if the above-mentioned multiple components are not well connected to each other, heat dissipation effects are compromised. In solution, there is a conventional heat dissipation device provided on the market, which is one-piece formed and composed of a heat dissipation plate and a plurality of heat dissipation strips. The heat dissipation plate is made of a metal material, and the heat dissipation strips are cut from the heat dissipation plate and then the heat dissipation strips are stamped (also known as pressed) to extend and protrude from one side of the heat dissipation plate. Accordingly, production costs are reduced, and a heat dissipation area of the heat dissipation plate is increased.

However, conventional one-piece formed heat dissipation devices have some shortcomings. The main reasons are as follows: First, when the heat dissipation plate is stamped to form the heat dissipation strips, a stamping stress is concentrated at connection positions between the heat dissipation plate and the heat dissipation strips. These connection positions are often too thin and prone to break, which not only easily damages the heat dissipation strips, but also limits an extended length of the heat dissipation strip. As a result, the heat dissipation area cannot be increased. Secondly, because the heat dissipation strips on the heat dissipation plate are disposed at intervals and arranged according to height, such a structural design not only is difficult to achieve mass production, but also causes deformation and warpage of the heat dissipation plate due to an uneven stamping stress resulting from a stamping process. Therefore, the existing heat dissipation structure cannot meet the market demand, and has the deficiency of insufficient heat dissipation.

In view of this, the inventor of the present invention focused on the above-mentioned problems in conventional techniques, and concentrated on research and scientific theory to solve these problems.

SUMMARY

It is an objective of the present invention to provide a one-piece formed metal heat dissipation plate and a heat dissipation device having the same, which lowers an overall height, and can be used and installed in a small space (less restricted by a space). Moreover, by means of a heat dissipation strip with multiple ridge portions, the present invention has an increased surface heat dissipation area in a same unit area, which facilitates mass production and improves heat dissipation.

The present invention provides a one-piece formed metal heat dissipation plate, comprising: a substrate and a plurality of heat dissipation strips arranged in a longitudinal direction. The substrate comprises a first surface and a second surface arranged opposite to each other. Each of the heat dissipation strips comprises two connection ends connected to the first surface, at least two ridge portions between the two connection ends, and a plurality of concave-convex tooth portions formed on at least one side of at least one of the ridge portions. A cut slot is defined in the substrate corresponding to the at least two ridge portions of each of the heat dissipation strips, and the cut slot penetrates the first surface and the second surface.

According to one embodiment, each of the ridge portions comprises at least one peak portion and at least one trough portion connected to the adjacent peak portion, each peak portion is triangular-shaped or arc-shaped, and each trough portion is triangular-shaped or arc-shaped, or is a plane parallel to the first surface.

According to one embodiment, in each heat dissipation strip, a ridge height is defined between the highest peak portion and the lowest trough portion of each of the at least two ridge portions, the ridge heights gradually increase in the longitudinal direction, an amplitude of each ridge portion also gradually increases in the longitudinal direction, and a height difference is defined between the lowest trough portion of each ridge portion and the first surface.

According to one embodiment, in each heat dissipation strip, a ridge height is defined between the highest peak portion and the lowest trough portion of each of the at least two ridge portions, the ridge heights are equal in the longitudinal direction, an amplitude of each ridge portion is also equal in the longitudinal direction, and a height difference is defined between the lowest trough portion of each ridge portion and the first surface.

According to one embodiment, copper or copper alloy is disposed on the first surface and each of the heat dissipation strips, and the copper or the copper alloy is also disposed on each ridge portion having the concave-convex tooth portions and is located on a surface opposite to the concave-convex tooth portions.

According to one embodiment, the substrate and each heat dissipation strip are made of aluminum or aluminum alloy, and each of the concave-convex tooth portions is triangular-shaped, rectangular-shaped, arc-shaped, or a combination thereof.

The present invention further provides a heat dissipation device, comprising at least a one-piece formed metal heat dissipation plate and an electronic device installed on one side of the metal heat dissipation plate. The heat dissipation device comprises: a base and a plurality of heat dissipation strips. The base comprises a plurality of substrates, wherein each of the substrates comprises a first surface and a second surface arranged opposite to each other. Each of the heat dissipation strips comprises two connection ends connected to the first surface, at least two ridge portions arranged between the two connection ends, and a plurality of concave-convex tooth portions formed on at least one side of each of the at least two ridge portions. A cut slot is defined in the substrate corresponding to the at least two ridge portions, and the cut slot penetrates the first surface and the second surface.

According to one embodiment, the base further comprises a connection plate connecting the substrates, and the connection plate and the outermost two of the substrates together form a horseshoe shape.

According to one embodiment, the ridge portion comprises at least one peak portion and at least one trough portion, the peak portion is triangular-shaped or arc-shaped, and each wave trough is triangular-shaped or arc-shaped, or is a plane parallel to the first surface.

According to one embodiment, in each heat dissipation strip, a ridge height is defined between the highest peak portion and the lowest trough portion of each of the at least two ridge portions, and the ridge heights gradually increase in the longitudinal direction, so that an amplitude of each ridge portion also gradually increases in the longitudinal direction.

According to one embodiment, in each heat dissipation strip, a ridge height is defined between the highest peak portion and the lowest trough portion of each of the at least two ridge portions, the ridge heights are equal in the longitudinal direction, and an amplitude of each ridge portion is also equal in the longitudinal direction.

According to one embodiment, copper or copper alloy is disposed on the first surface and each of the heat dissipation strips, and the copper or the copper alloy is disposed on each ridge portion having the concave-convex tooth portions and is located on a surface opposite to the concave-convex tooth portions.

According to one embodiment, the base and each heat dissipation strip are made of aluminum or aluminum alloy, and each of the concave-convex tooth portions is triangular-shaped, rectangular-shaped, arc-shaped, or a combination thereof.

The present invention provides the one-piece formed metal heat dissipation plate and the heat dissipation device using the same. By having the low-height/high-density-arrangement ridge portions and the concave-convex tooth portions, the ridge portions have a low overall height, are many in number, and are easy to produce. As a result, a surface heat dissipation area in a same unit area is increased, so the surface heat dissipation area and heat dissipation can be effectively improved. Therefore, in the embodiment, the concave-convex tooth portions are used to spread a stamping stress originally concentrated on the two connection ends of the metal heat dissipation plate to the entire heat dissipation strip, so the ridge portions of the heat dissipation strip are more easily extended and deformed. In addition, the stamping stress generated by stamping can also be released by the cut slot having a longer length, so the stamping stress is not just concentrated on the two connection ends of the metal heat dissipation plate to cause deformation and warpage. Furthermore, the concave-convex tooth portions can improve extensibility of the ridge portions of each heat dissipation strip, and reduces a risk that the heat dissipation strip easily breaks during processing. Therefore, the metal heat dissipation plate of the present embodiment does not generate any waste and has low production costs. The one-piece formed metal heat dissipation plate with multiple ridge portions and multiple concave-convex tooth portions greatly increases the surface heat dissipation area to improve heat dissipation, and also facilitates mass production.

BRIEF DESCRIPTION OF DRAWINGS

For ease of understanding the above content of the present invention, a detailed description is provided below with reference to preferable embodiments and in conjunction with the accompanying drawings.

DETAILED DESCRIPTION OF EMBODIMENTS

Figure 1A:
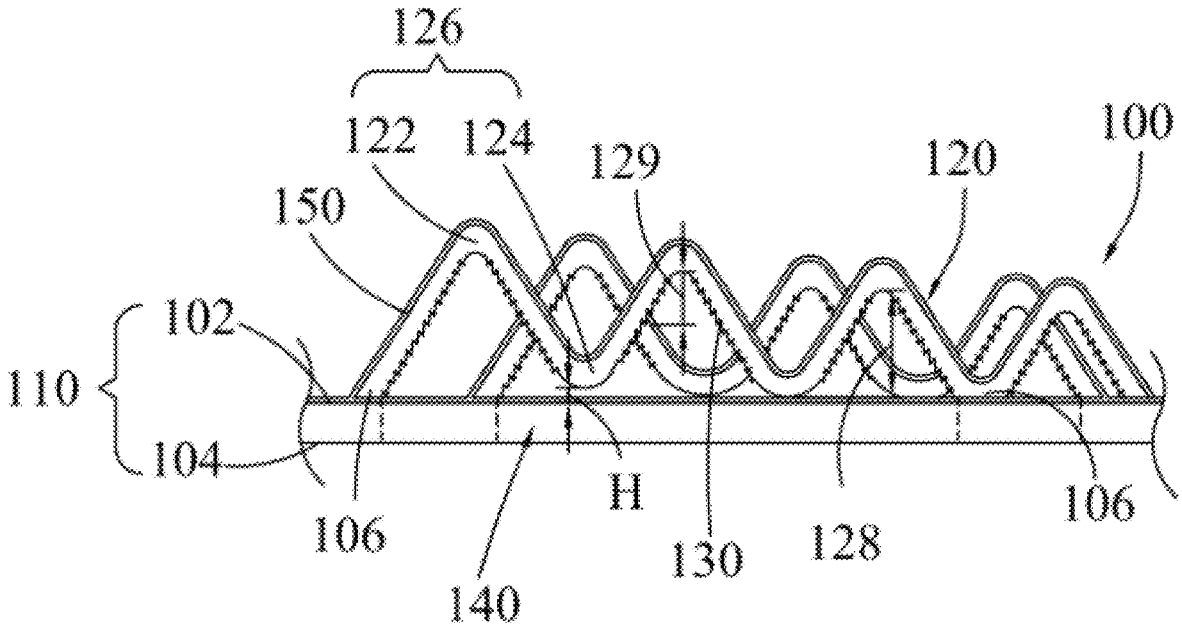
FIG. 1A is a schematic view illustrating a one-piece formed metal heat dissipation plate according to a first embodiment of the present invention.

Please refer to the accompanying drawings, in which same reference numerals/letters represent the same components or similar components, and working principles of the present disclosure are described using examples in a suitable environment. The following descriptions are provided with reference to specific embodiments of the present disclosure, and should not be construed as limiting other embodiments of the present disclosure that are not specified herein.

Figure 1B:
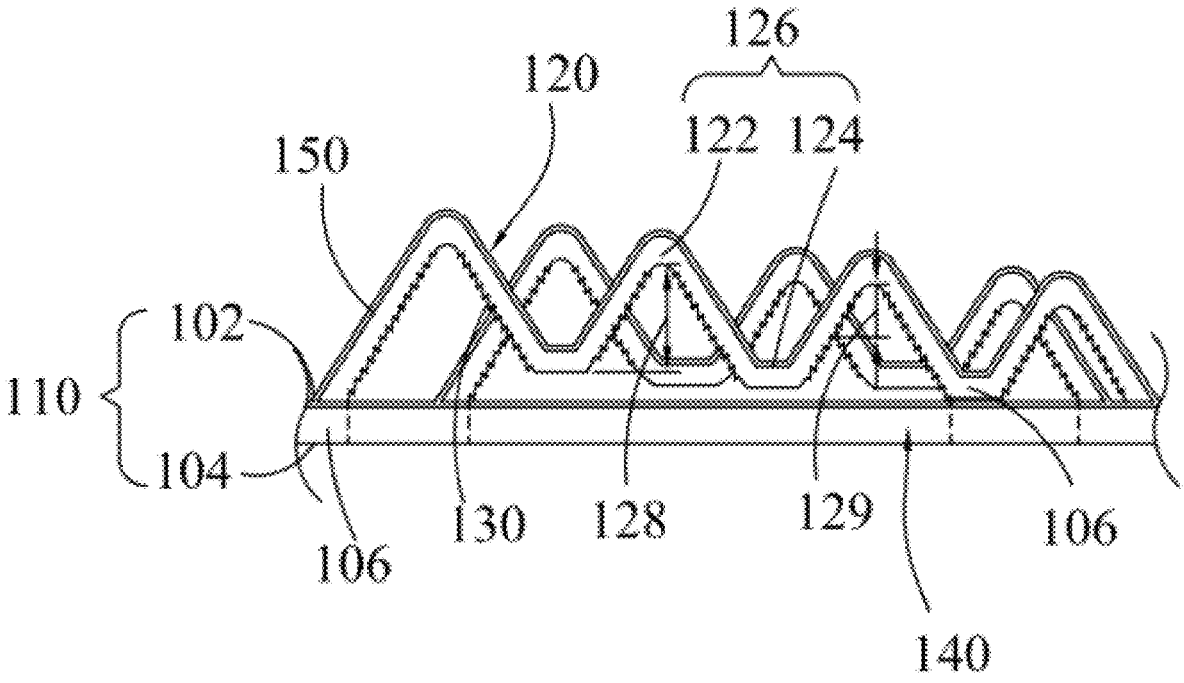
FIG. 1B is a schematic view illustrating the one-piece formed metal heat dissipation plate according to a second embodiment of the present invention.

As shown in FIG. 1A and FIG. 1B, the present invention provides a one-piece formed metal heat dissipation plate 100, comprising: a substrate 110 and a plurality of heat dissipation strips 120 arranged in a longitudinal direction. The substrate 110 includes a first surface 102 and a second surface 104 disposed opposite to each other. Each heat dissipation strip 120 includes two connection ends 106 connected to the first surface 102, at least two ridge portions 126 arranged between the two connection ends 106, and a plurality of concave-convex tooth portions 130 formed on at least one side of at least one of the at least two ridge portions 126. A cut slot 140 is defined in the substrate 110 corresponding to the at least two ridge portions 126 of each heat dissipation strip 120, and the cut slot 140 penetrates the first surface 102 and the second surface 104.

Each of the ridge portions 126 includes at least one peak portion 122 and at least one trough portion 124 connected to the adjacent peak portion 122. Each peak portion 122 is, for example, triangular-shaped or arc-shaped, or is of other suitable shape. The trough portion 124 is, for example, triangular-shaped or arc-shaped, or is a plane parallel to the first surface 102. In the embodiment shown in FIG. 1A, each peak portion 122 and each trough portion 124 is preferably triangular, which makes overall heat dissipation efficiency be about 80%. In the embodiment shown in FIG. 1B, the trough portion 124 preferably has a planar shape, so that the overall heat dissipation efficiency is as high as 90%. In other different embodiments, each peak portion 122 and each trough portion 124 can be arc-shaped, triangular-shaped, or a combination thereof as required for use in different environments.

In addition, in the present embodiment as shown in FIGS. 1A and 1B, in each heat dissipation strip 120, a ridge height 128 between the highest peak portion and the lowest trough portion of each of the at least two ridge portions 126 gradually increases in the longitudinal direction. In other words, an amplitude 129 also gradually increases in the longitudinal direction. This effectively increases a heat dissipation area, and thereby can also improve heat dissipation. However, in other different embodiments, the ridge height 128 of each of the at least two ridge portions 126 is designed to be equal in the longitudinal direction. That is, the amplitudes 129 are also equal in the longitudinal direction. Such configuration can also achieve good heat conduction and heat dissipation. It should be noted that the ridge height 128 is preferably less than 20 millimeters (mm), so that the ridge portions 126 have a low overall height, and are many in number, and are easy to produce, thus increasing a surface heat dissipation area in a same unit area. There is a height difference H between the lowest trough portion 124 of the ridge portion 126 and the first surface 102, and the trough portion 124 is in a range of, for example, 1 mm to 10 mm. The height difference H can be designed to be a fixed value or gradually increase in the longitudinal direction, and configuration may vary as required.

A material of the substrate 110 and each heat dissipation strip 126 includes aluminum or aluminum alloy, and each concave-convex tooth portion 130 is triangular-shaped, rectangular-shaped, or arc-shaped, or a combination thereof. Each concave-convex tooth portion 130 is preferably triangular-shaped. Because it is not easy for heat to stay at a tip of the triangle, the heat can be removed more quickly, and thus the heat dissipation is improved. In other different embodiments, each concave-convex tooth portion 130 can also be arc-shaped or of other suitable shape, and the present application is not limited in this regard. In the embodiment of FIG. 1A and FIG. 1B, copper 150 or copper alloy is disposed on the first surface 102 and each heat dissipation strip 126 by coating, electroplating, or other suitable methods. Thermal conductivity of the copper 150 is twice thermal conductivity of aluminum. In the present embodiment, thermal conductivity and heat dissipation can be improved by means of the copper 150 or the copper alloy. Specifically, the copper 150 or the copper alloy is preferably disposed on each ridge portion 126 having the concave-convex tooth portions 130 and is located on a surface opposite to the concave-convex tooth portions 130. However, in other different embodiments, the copper 150 or the copper alloy can also be disposed on the first surface 102 and the second surface 104 at the same time, and configuration may vary as required.

In the embodiment shown in FIG. 1A and FIG. 1B, a main material of the whole structure of the present invention is preferably pure aluminum or aluminum alloy, and at least one layer of pure copper 150 or two layers of the copper alloy are arranged on the structure. In other different embodiments, various other metals or alloys thereof can even be disposed on the pure copper 150 or the copper alloy, or two-layer composite metal materials (such as copper and aluminum composite materials) can be disposed on the pure copper 150 or the copper alloy to form two layers or three layers on the heat dissipation strip 120. A thickness of each layer varies according to actual application or use and according to heat dissipation conditions, and the present application is not limited in this regard. It should be noted that the afore-mentioned composite material can be an intermetallic layer consisting of two or more metals fused together. The three layers formed on the heat dissipation strip 120 are formed by various metals or alloys thereof superimposed on each other or fused together, and the present application is not limited in this regard. The above-mentioned other pure metals or alloys thereof include, but are not limited to, nickel, tin, zinc, silver, gold, iron, stainless steel, titanium, tungsten, beryllium, and bismuth.

A method of forming the heat dissipation strips 120 is described below. The concave-convex teeth portions 130 are formed on each ridge portion 126 of each heat dissipation strip 120 by, for example, stamping. The concave-convex tooth portions 130 in FIG. 1A are continuous or discontinuous on a surface of the ridge portion 126. However, the concave-convex tooth portions 130 in FIG. 1B on the trough portion 124 of each ridge portion 126 have to be flattened by another stamping process to form a flat surface. In detail, after the concave-convex tooth portions 130 are formed, each heat dissipation strip 120 is stamped again, so that each heat dissipation strip 120 forms the at least two ridge portions 126 which extend out of any one surface of the metal heat dissipation plate 100. For example, the at least two ridge portions 126 of each heat dissipation strip 120 extend out of the first surface 102 to form the cut slot 140 corresponding to the at least two ridge portions 126. The at least two ridge portions 126 shown in the present embodiment preferably include three peak portions 122 and two trough portions 124; however, the present application is not limited in this regard.

Through the low-height and high-density-arrangement ridge portions 126 and the concave-convex tooth portions 130, the surface heat dissipation area of each heat dissipation strip 120 can be increased, so that in the same unit area, the surface heat dissipation area is increased, and heat dissipation is improved. Therefore, in the present embodiment, the concave-convex tooth portions 130 are used to spread the stamping stress originally concentrated on the two connection ends 106 of the metal heat dissipation plate 100 to the entire heat dissipation strip 120, so the ridge portions 126 of the heat dissipation strip 120 are more easily extended and deformed. In addition, the stamping stress generated by stamping can also be released from the cut slot 140 having a longer length, so the stamping stress is not just concentrated on the two connection ends 106 of the metal heat dissipation plate 100 to cause deformation and warpage. Furthermore, the concave-convex tooth portions 130 can improve extensibility of the ridge portions 126 of each heat dissipation strip 120, and reduces a risk that the heat dissipation strip 120 easily breaks during processing. Therefore, the metal heat dissipation plate 100 of the present embodiment does not generate any waste and has low production costs. The one-piece formed metal heat dissipation plate 100 with multiple ridge portions 126 and multiple concave-convex tooth portions 130 greatly increases the surface heat dissipation area to improve heat dissipation, and also facilitates mass production.

Please refer to FIGS. 2 to 5 together. The present invention also provides a heat dissipation device 200, which includes at least a one-piece formed metal heat dissipation plate 100 and an electronic device 300 installed on one side of the metal heat dissipation plate 100. The electronic device 300 referred to here can be applied to all industries related to heat conduction, heat convection, heat radiation, and the like. For example, the electronic device 300 can be used in central processing units (CPU), graphics processing units (GPU), network processing units (NPU), and other electronic products. Alternatively, the electronic device 300 can be used in heat exchangers or heat exchange systems for semiconductor heat sinks, solar cells, car batteries, and power plants to improve heat dissipation and energy efficiency. The heat dissipation device 200 includes a base 210 and a plurality of heat dissipation strips 120 arranged in a longitudinal direction. The base 210 includes a plurality of substrates 110, and each substrate 110 includes a first surface 102 and a second surface 104 opposite to each other. Each heat dissipation strip 120 includes two connection ends 106 connected to the first surface 102, at least two ridge portions 126 between the two connection ends 106, and a plurality of concave-convex tooth portions 130 formed on at least one side of at least one of the at least two ridge portions 126. A cut slot 140 is defined in the substrate 110 corresponding to the at least two ridge portions 126 of each heat dissipation strip 120, and the cut slot 140 penetrates the first surface 102 and the second surface 104.

Figure 2:
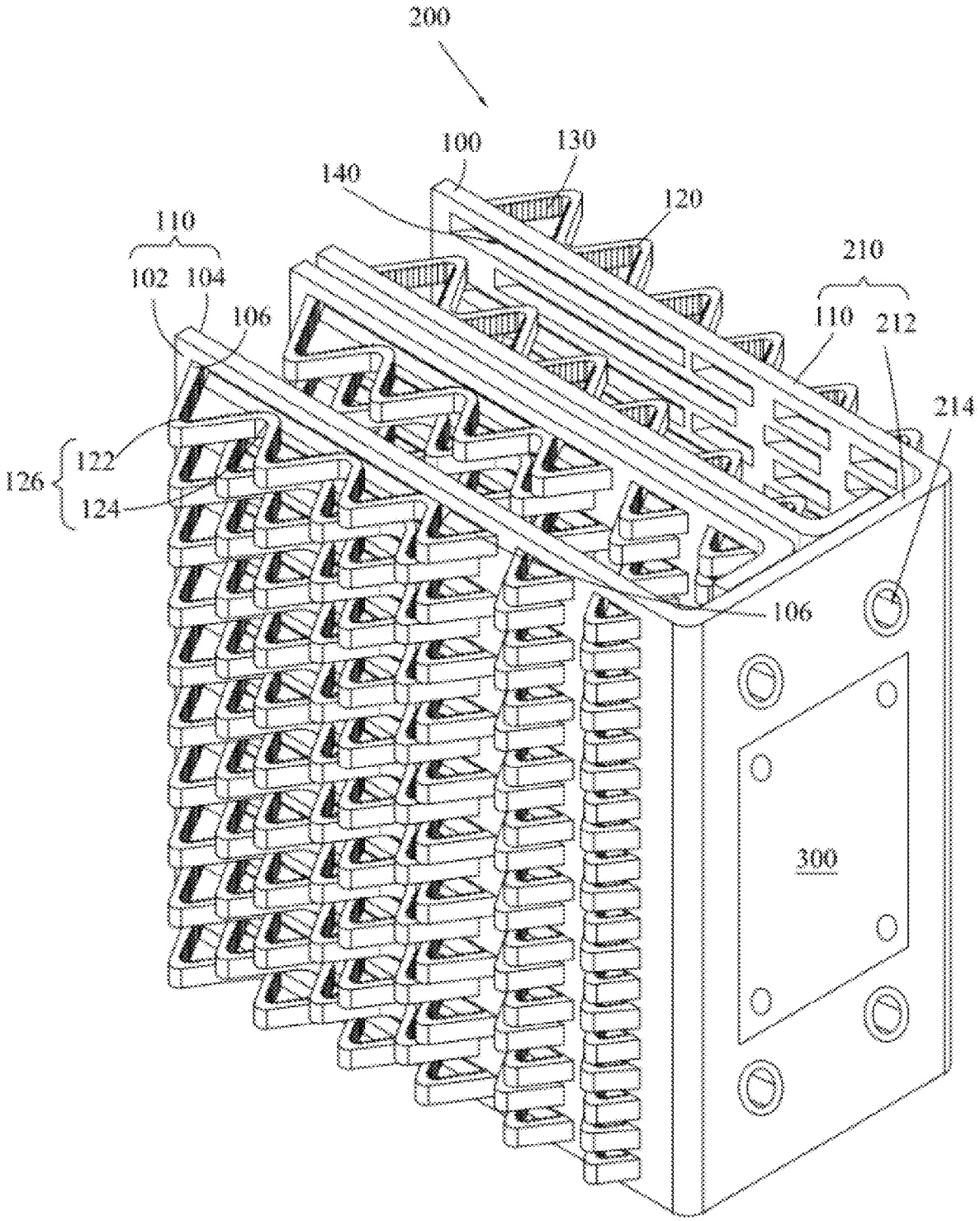
FIG. 2 is a perspective view of a heat dissipation device of the present invention.
Figure 5:
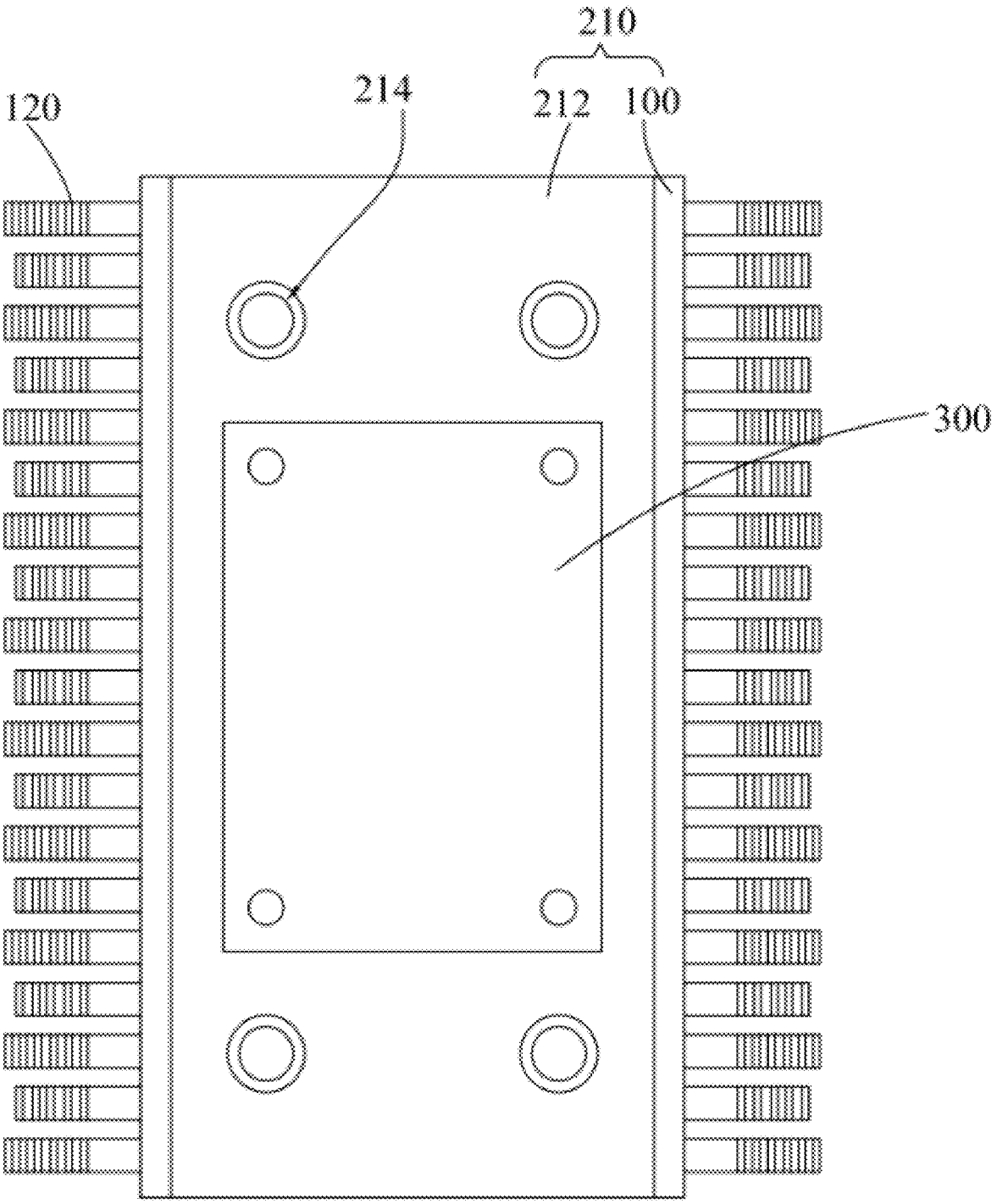
FIG. 5 is a schematic view illustrating that an electronic device is installed on a connection plate according to the present invention.

In the embodiment shown in FIG. 2 and FIG. 5, the base 210 further includes a connection plate 212 connecting the substrates 110, and the electronic device 300 can be securely mounted on one side of the connection plate 212 by means of screw connection elements (e.g., screws, not illustrated) and the assembly holes 214. The connection plate 212 and the outermost two of the substrates 110 together form a horseshoe shape (U-shaped). However, in other different embodiments, the base 210 can also be made into a rectangle, a disc shape, or other appropriate shape, depending on requirements or environments. When the electronic device 300 generates heat during operation, the connection plate 212 of the heat dissipation device 200 and the heat dissipation strips 120 connected to the heat dissipating plates 100 quickly transfer and remove heat, so as to achieve heat dissipation. Regarding a specific structure, a manufacturing method, and other detailed features of each metal heat dissipation plate 100 of the heat dissipation device 200, please refer to the foregoing embodiments, and a detailed description is not repeated here.

Figure 6:
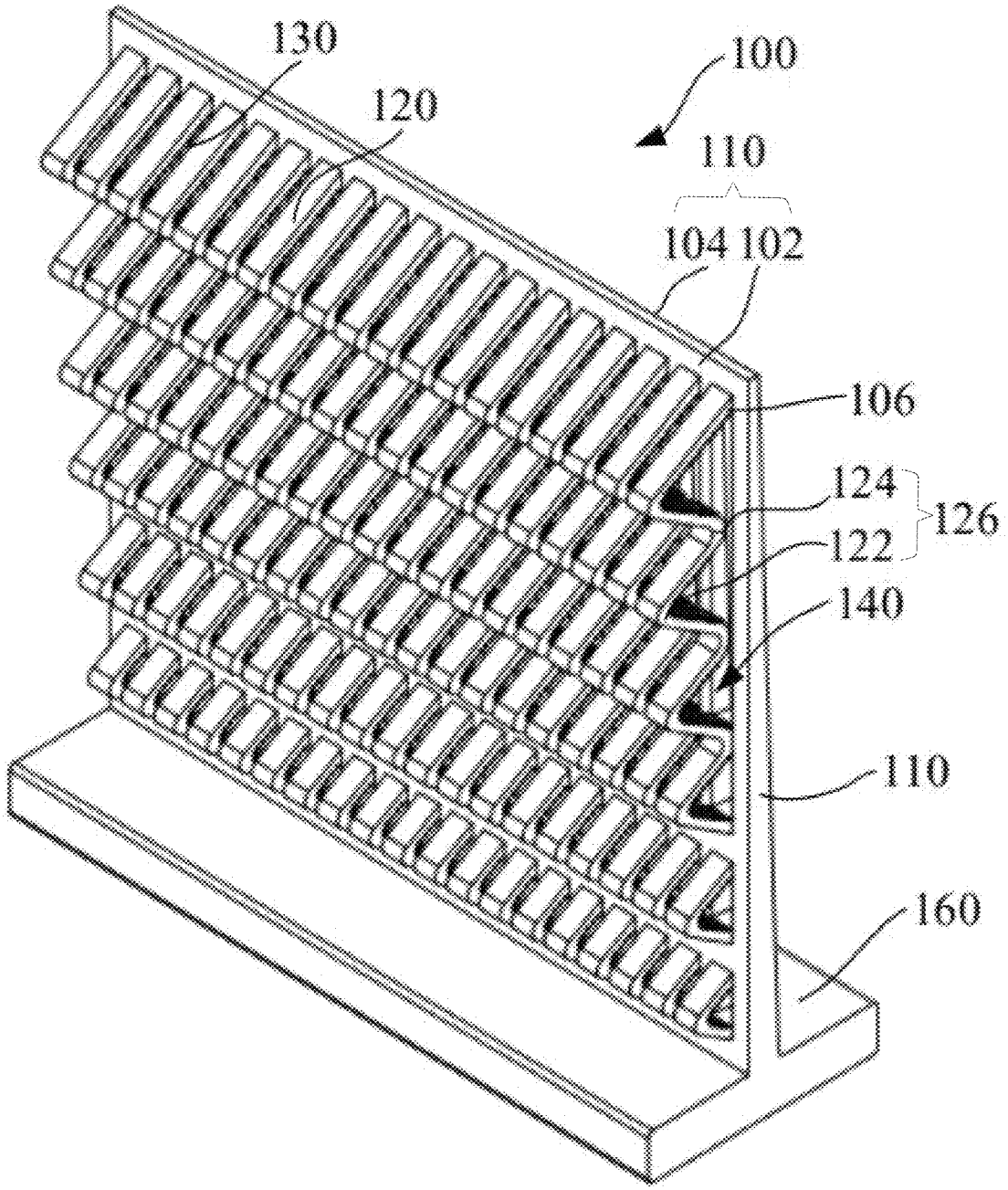
FIG. 6 is a schematic view of the one-piece formed metal heat dissipation plate according to a third embodiment of the present invention.
Figure 7:
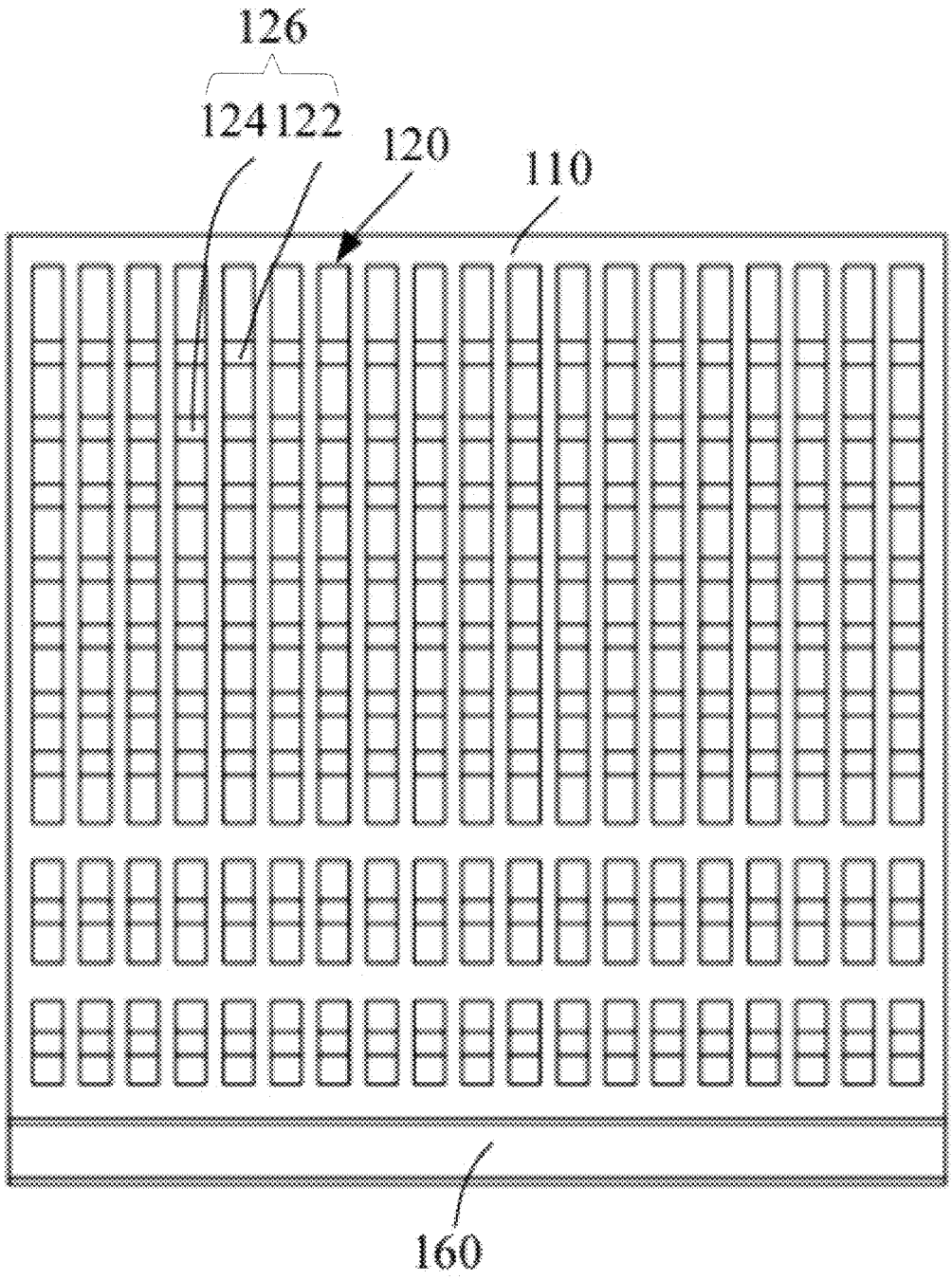
FIG. 7 is a side view of FIG. 6.
Figure 8:
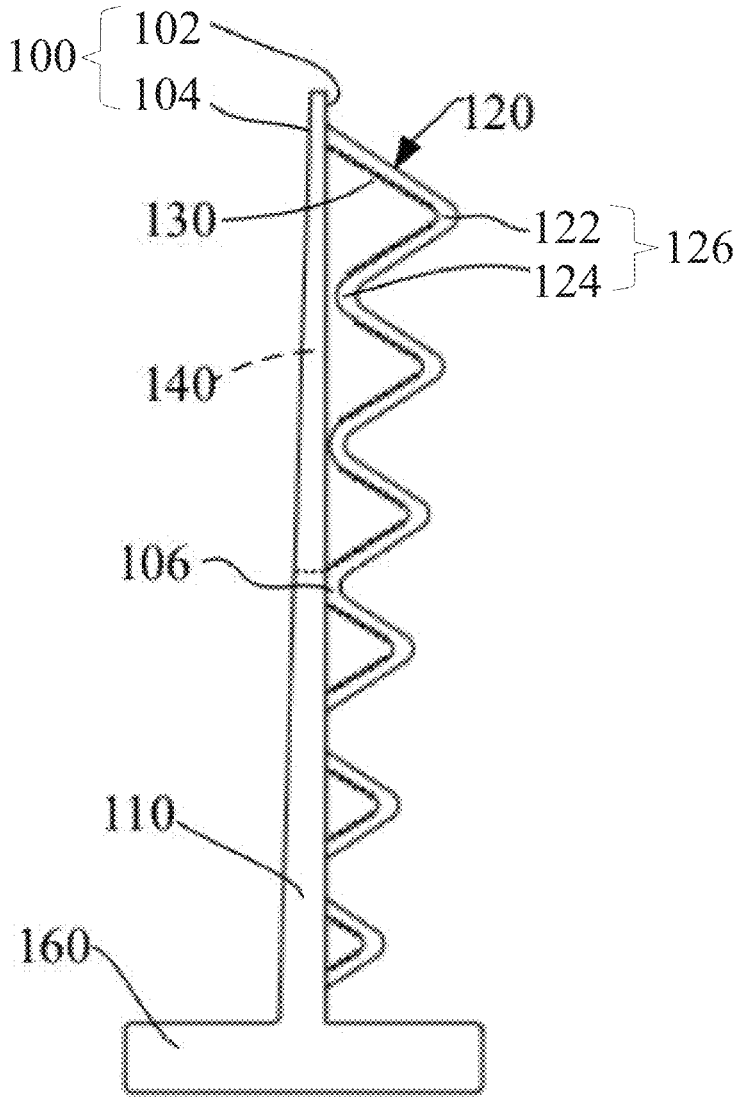
FIG. 8 is another side view of FIG. 6.

Please refer to FIGS. 6 to 8 together, which are a perspective view and a side view of the one-piece formed metal heat dissipation plate 100 of the present invention. A main difference between the present embodiment and the above-mentioned embodiments is that the present embodiment has only one substrate 100, one end of the substrate 110 is connected to a support plate 160, the support plate 160 and the substrate 110 are perpendicular to each other, and then the support plate 160 is fixed to the base 210 of the heat dissipation device 200. A thickness of the substrate 110 gradually becomes thinner in a direction away from the support plate 160. Similarly, this allows heat to be removed more quickly because it is difficult for heat to stay at a tip. As a result, the present application achieves better heat dissipation. Regarding a specific structure, a manufacturing method, and other detailed features of the metal heat dissipation plate 100, reference can be made to the foregoing embodiments, and a detailed description is omitted here for brevity.

Figure 3A:
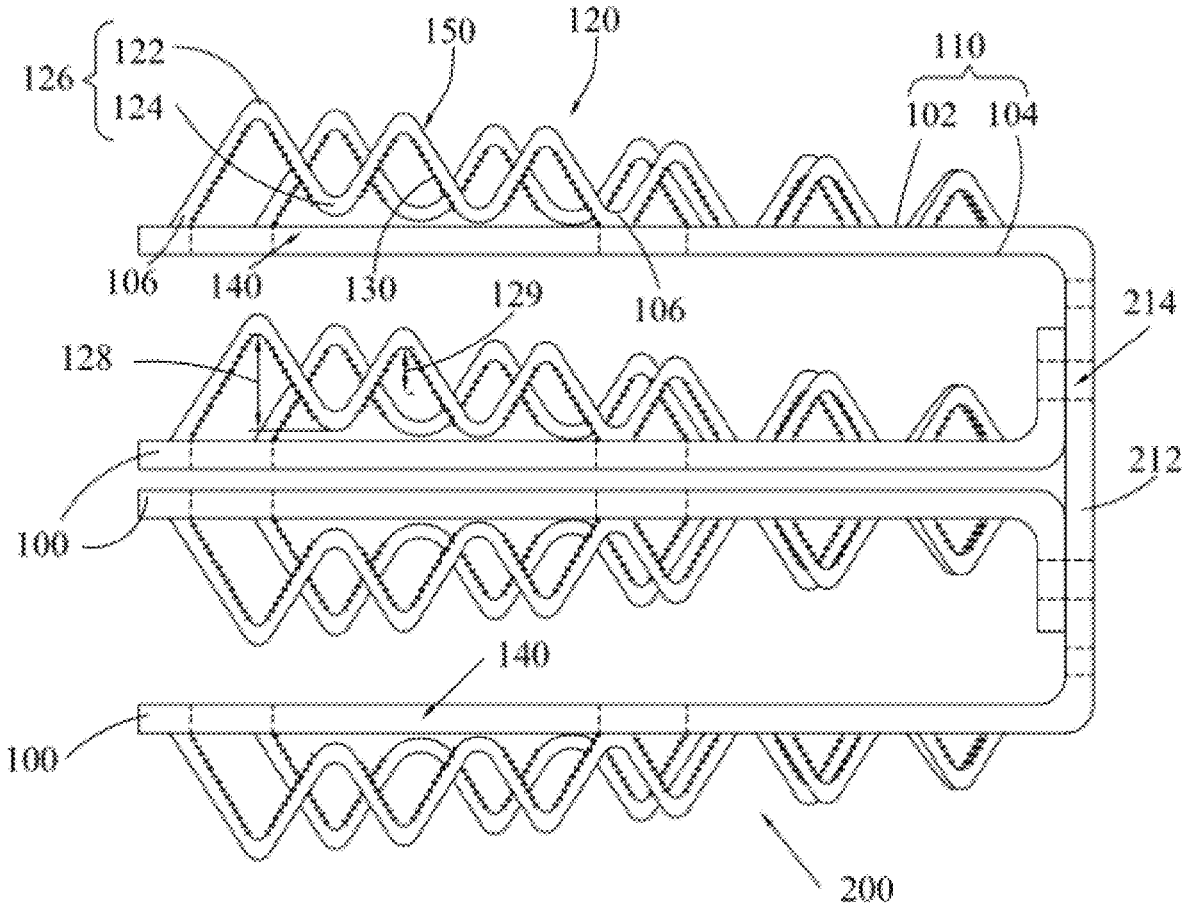
FIG. 3A is a side view of the heat dissipation device of the present invention.
Figure 3B:
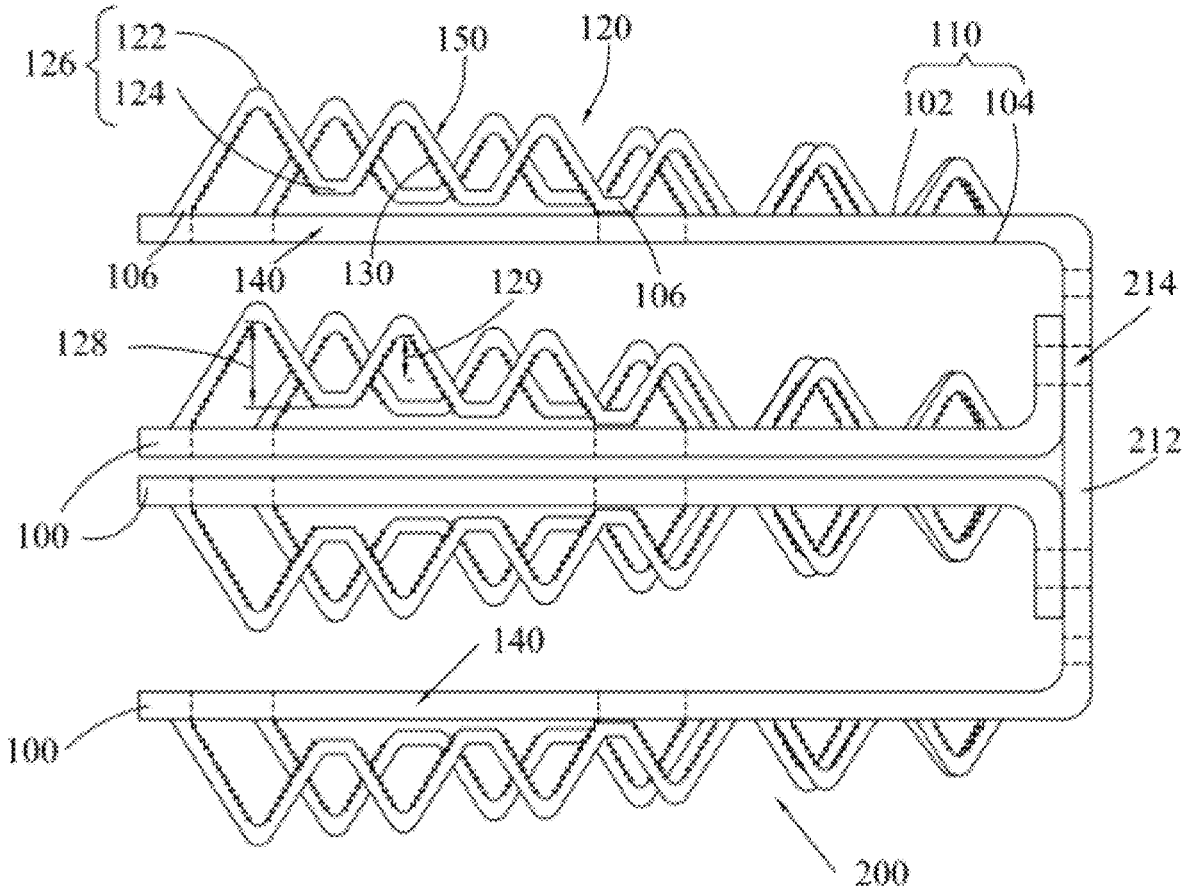
FIG. 3B is another embodiment of FIG. 3A.
Figure 4:
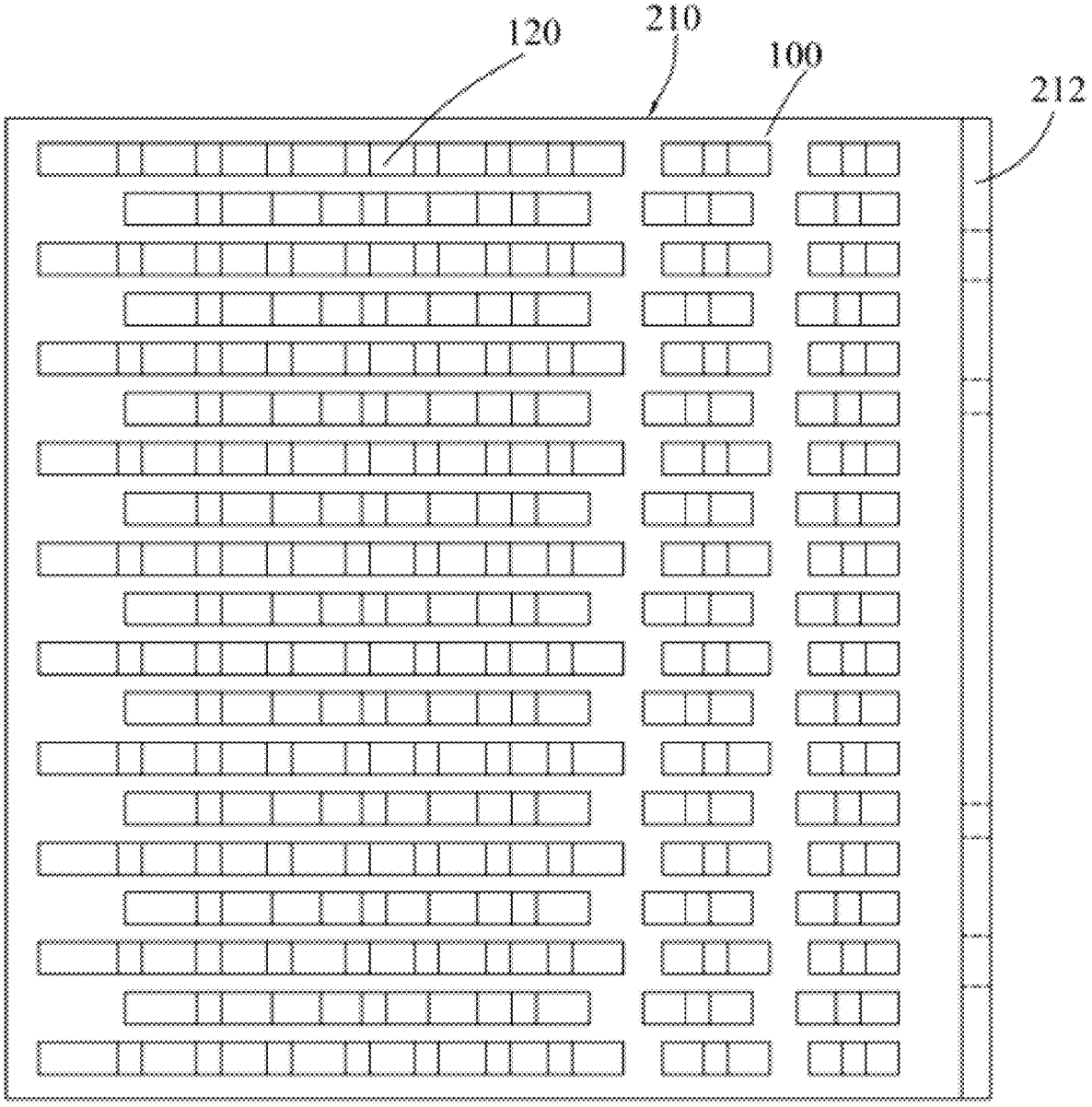
FIG. 4 is another side view of the heat dissipation device of the present invention.

The heat dissipation device 200 of the present embodiment is provided with multiple metal heat dissipation plates 100. Each metal heat dissipation plate 100 is provided with a plurality of ridge portions 126 arranged at intervals. According to size or requirements, each metal heat dissipation plate 100 connected to the connection plate 212 can be provided with only one heat dissipation strip 120. As shown in the embodiments of FIGS. 2 and 3A-3B, the ridge heights 128 of each heat dissipation strip 120 preferably gradually increase toward an opening (not labeled) of the base 210, so the surface heat dissipation area per unit area also gradually increases, thereby improving the heat dissipation and heat dissipation efficiency. Through experiments, it is found that, under the same conditions, data is 9503 pts while the heat dissipation device 200 is used to test a CPU (for example: Ryzen 5 3600XT), which increases the heat dissipation by 20% compared to conventional techniques. Therefore, by means of the greatly increased surface heat dissipation area, and the heat dissipation device 200 surely can improve the heat dissipation.

Figure 9:
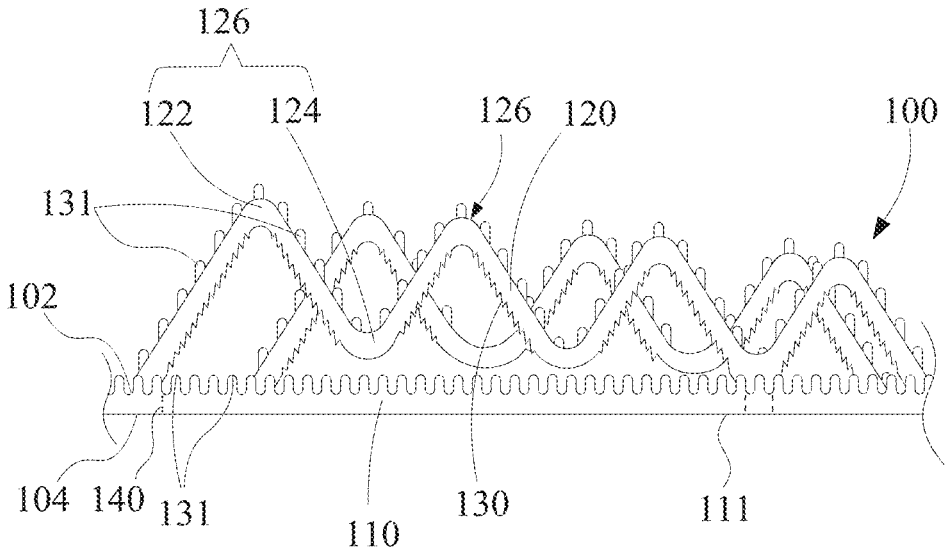
FIG. 9 is a schematic structural view of a one-piece formed metal heat dissipation plate according to a fourth embodiment of the present invention.
Figure 10:
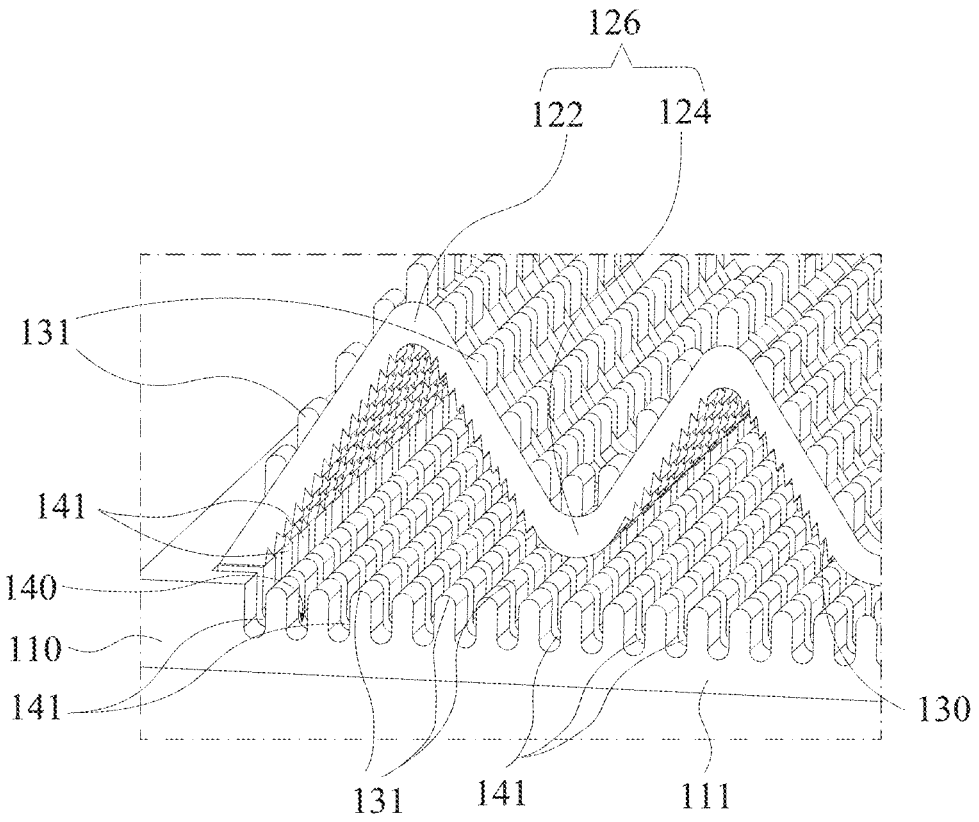
FIG. 10 is a schematic structural perspective view of the one-piece formed metal heat dissipation plate according to the fourth embodiment of the present invention.

In a fourth embodiment, with reference to FIGS. 9 and 10, the one-piece formed metal heat dissipation plate 100 further includes two frame strips 111 disposed at two lateral edges of the substrate 110 opposing each other, and a plurality of heat dissipation fins 131. In some embodiments, the heat dissipation fins 131 are integrally formed on the two frame strips 111 and/or each of the ridge portions 126 by a stamping process. Specifically, the heat dissipation fins 131 protrude outward from upper surfaces of the frame stripes 111 and/or the ridge portions 126 and are spaced apart from each other. As shown in FIG. 9, the heat dissipation fins 131 extend in a direction opposite to a direction where the concave-convex tooth portions 130 extend. The heat dissipation fins 131 as well as the concave-convex tooth portions 130 are configured to increase area for heat dissipation, thus enhancing the performance of heat dissipation.

In some embodiments, as shown in FIG. 10, a plurality of dividing strips 141 are formed in conjunction with the cut slots 140 and adjoin the cut slots 140, respectively. The heat dissipation fins 131 can be formed on upper surfaces of the dividing strips 141 to further enhance the performance of heat dissipation.

Figure 11:
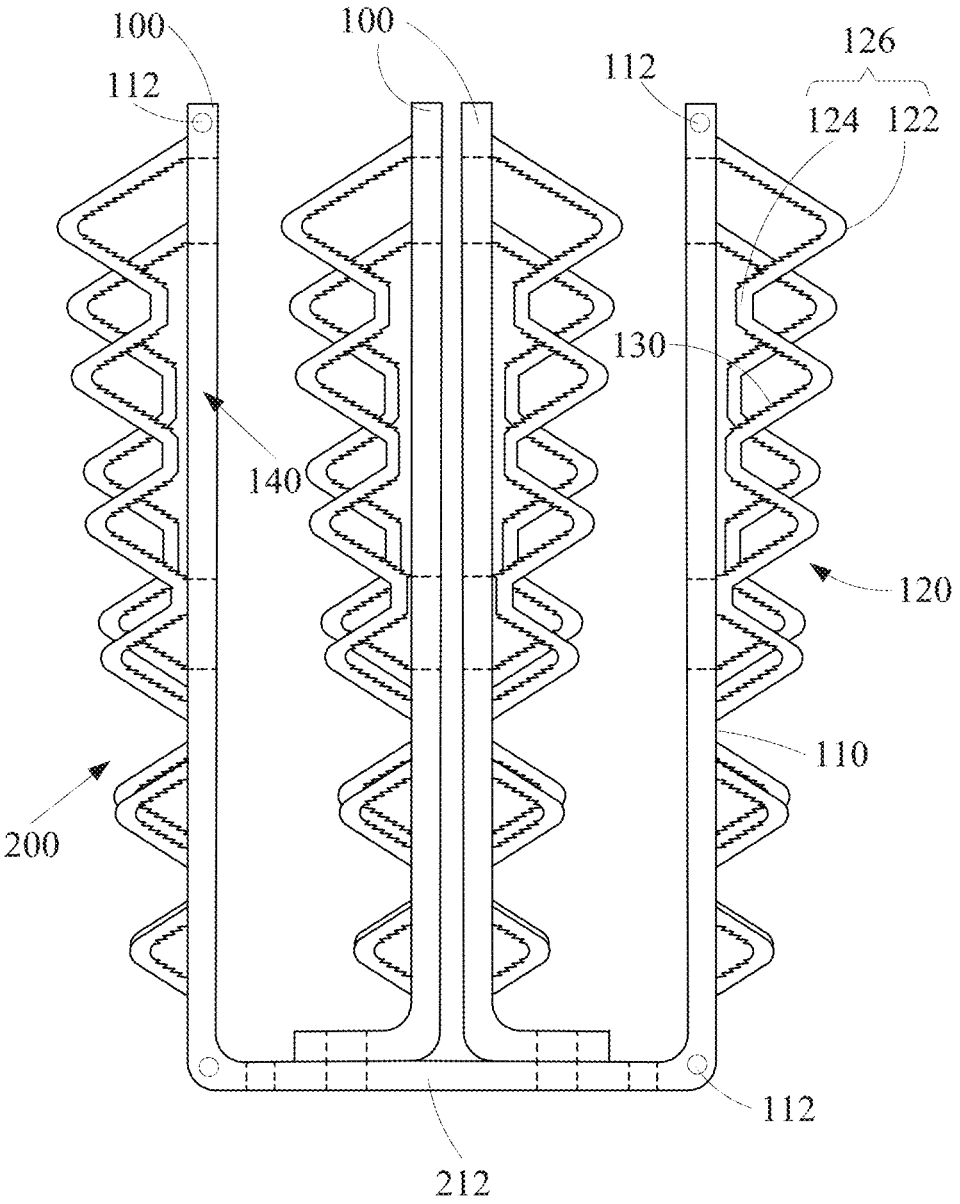
FIG. 11. is a schematic view illustrating a one-piece formed metal heat dissipation plate having a plurality of assembly portions for a heat pipe according to a fifth embodiment of the present invention.
Figure 12:
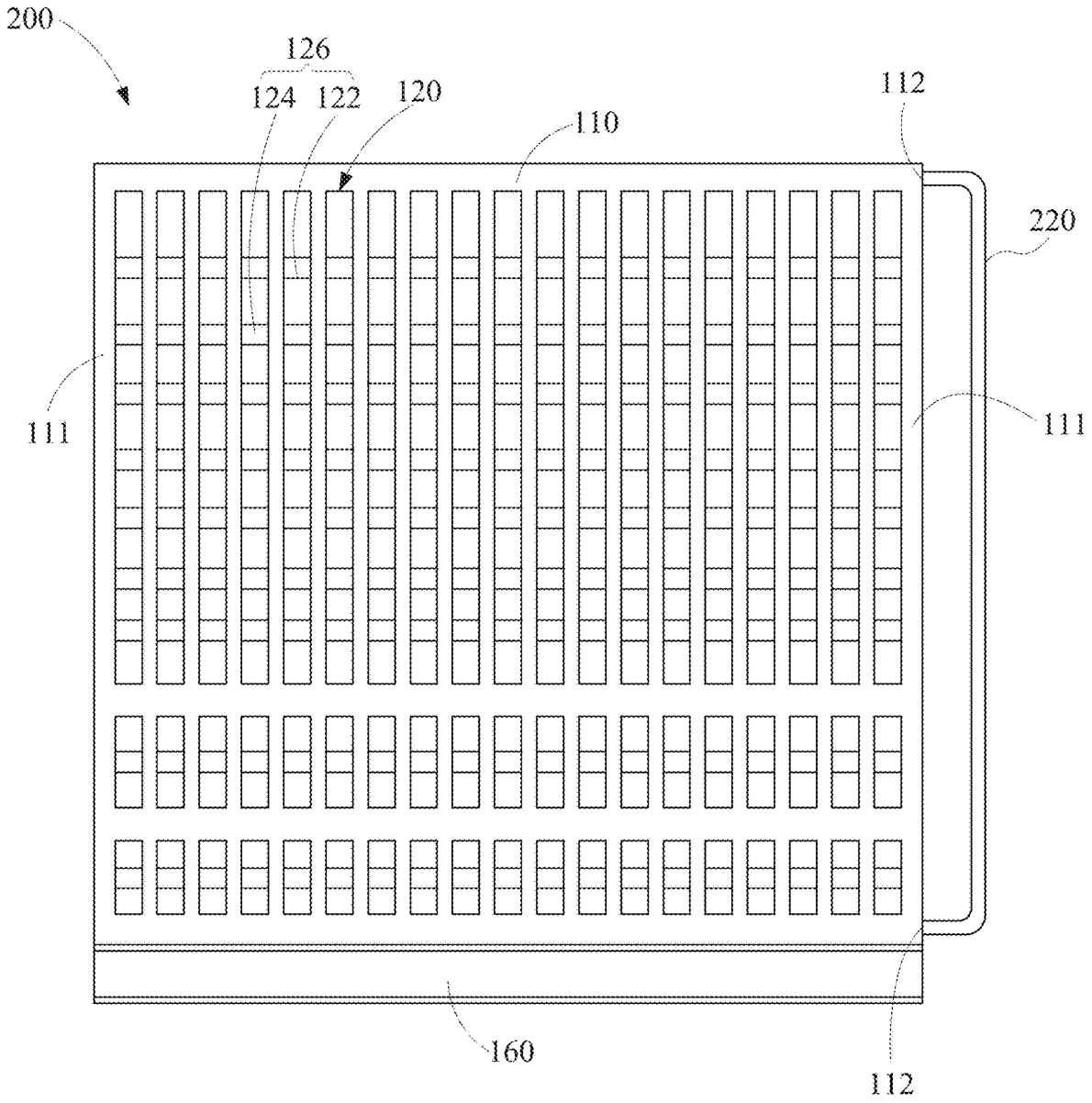
FIG. 12 is a schematic structural view illustrating the heat pipe assembled to the one-piece formed metal heat dissipation plate according to the fifth embodiment of the present invention.

In a fifth embodiment, with reference to FIGS. 11 and 12, the substrate 110 is provided with a plurality of assembly portions 112 arranged on top and bottom ends of a lateral edge of the substrate 110, and the dissipation device 200 further includes at least a heat pipe 220. The heat pipe 220 may be preferably U-like in shape, and opposite two ends of the heat pipe 220 are assembled to the assembly portions 112. In some embodiments, the assembly portions 112 may be screw holes, so that the heat pipe 220 is configured to be firmly screwed to the assembly portions 112. Alternatively, the assembly portions 112 may be applied with an adhesive having heat transfer properties, so that the heat pipe 220 is configured to be fixed to the assembly portions 112 through the adhesive. With the provision of the heat pipe 220, heat from the electronic device 300 can be quickly transferred and dissipated because the heat is transferred from the top and bottom ends of the lateral edge of the substrate 110 earlier than other areas of the substrate 110, thus further enhancing the performance of heat dissipation. It should be noted that the heat dissipation fins 131 and the heat pipe 220 can also be used in any of the above-mentioned embodiments.

Figure 13:
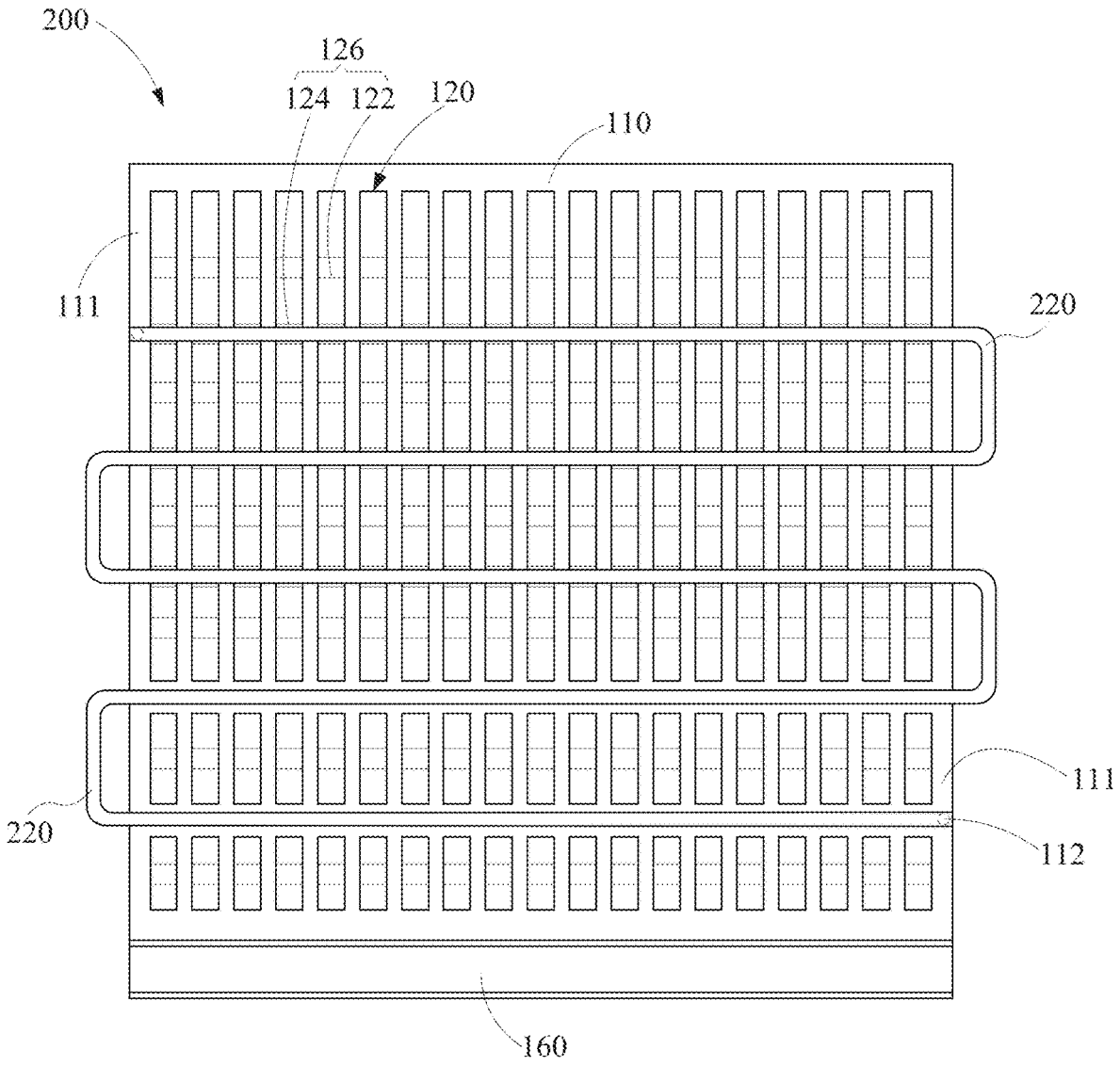
FIG. 13 is a schematic structural view illustrating a heat pipe assembled to a one-piece formed metal heat dissipation plate according to a sixth embodiment of the present invention.

In a sixth embodiment, with reference to FIG. 13, the assembly portions 112 are arranged on a front side of the substrate 110. The heat pipe 220 is located above the trough portions 124 and extends across the ridge portions 126 in rows from a top to a bottom of the substrate 110. That is, in a side view of the dissipation device 200, the heat pipe 220 has a profile including multiple S-like shapes connected to each other. In this way, the length of the heat pipe 220 is significantly increased, thus enhance the performance of heat dissipation. It should be noted that the heat pipe 220 may also be assembled to other positions of the substrate 110, including but not limited to the front side, the lateral edge, and a rear side of substrate 110.

In some embodiments, the metal heat dissipation plate 100 may be miniaturized to be compatible with electronic products small in size, such as semiconductor components, but not limited thereto. For example, the metal heat dissipation plate 100 may be assembled to a packaged chip (not shown) to facilitate heat dissipation of the packaged chip.

Through the low-height/high-density-arrangement ridge portions 126 and the concave-convex tooth portions 130, the surface heat dissipation area of the heat dissipation strip 120 can be increased, so the surface heat dissipation area and the heat dissipation in the same unit area can be effectively increased. Therefore, in this embodiment, the concave-convex tooth portions 130 are used to spread the stamping stress originally concentrated on the two connection ends 106 of the metal heat dissipation plate 100 to the entire heat dissipation strip 120, so the ridge portions 126 of the heat dissipation strip 120 are more easily extended and deformed. In addition, the stamping stress generated by stamping can also be released by the cut slot 140 having a longer length, so the stamping stress is not just concentrated on the two connection ends 106 of the metal heat dissipation plate 100 to cause deformation and warpage. Furthermore, the concave-convex tooth portions 130 can improve extensibility of the ridge portions 126 of each heat dissipation strip 120, and reduces a risk that the heat dissipation strip 120 easily breaks during processing. Therefore, the metal heat dissipation plate 100 of the present embodiment does not generate any waste and has low production costs. The one-piece formed metal heat dissipation plate 100 with multiple ridge portions 126 and multiple concave-convex tooth portions 130 greatly increases the surface heat dissipation area to improve heat dissipation, and also facilitates mass production.

The above descriptions are only preferable embodiments of the present invention, and are not intended to limit the protection scope of the present invention. All equivalent changes based on the spirit of the present invention should be deemed to fall within the protection scope of the present invention.

What is claimed is:

1. A one-piece formed metal heat dissipation plate, comprising:

a substrate comprising a first surface and a second surface arranged opposite to each other; and a plurality of heat dissipation strips arranged in a longitudinal direction;

wherein each of the heat dissipation strips comprises two connection ends connected to the first surface, at least two ridge portions arranged between the two connection ends and located over the substrate, and a plurality of concave-convex tooth portions formed on at least one side of at least one of the ridge portions, and a cut slot is defined in the substrate corresponding to the at least two ridge portions of each of the heat dissipation strips, and the cut slot penetrates the first surface and the second surface;

wherein the substrate further comprises a plurality of dividing strips each disposed adjacent to and extending along the respective cut slots and located below the ridge portions, and a plurality of heat dissipation fins arranged on the dividing strips and adjacent to the respective cut slots, wherein the first surface is connected between adjacent ones of the heat dissipation fins arranged in a direction along a respective one of the cut slots.

2. The one-piece formed metal heat dissipation plate according to claim 1, wherein each of the ridge portions comprises at least one peak portion and at least one trough portion connected to the adjacent peak portion, each peak portion is triangular-shaped or arc-shaped, and each trough portion is triangular-shaped or arc-shaped, or is a plane parallel to the first surface.

3. The one-piece formed metal heat dissipation plate according to claim 2, wherein in each heat dissipation strip, a ridge height is defined between the highest peak portion and the lowest trough portion of each of the at least two ridge portions, the ridge heights gradually increase in the longitudinal direction, an amplitude of each ridge portion gradually increases in the longitudinal direction, and a height difference is defined between the lowest trough portion of each ridge portion and the first surface.

4. The one-piece formed metal heat dissipation plate of claim 2, wherein in each heat dissipation strip, a ridge height is defined between the highest peak portion and the lowest trough portion of each of the at least two ridge portions, the ridge heights are equal in the longitudinal direction, an amplitude of each ridge portion is equal in the longitudinal direction, and a height difference is defined between the lowest trough portion of each ridge portion and the first surface.

5. The one-piece formed metal heat dissipation plate according to claim 1, wherein copper or copper alloy is disposed on the first surface and each of the heat dissipation strips, and the copper or the copper alloy is disposed on each ridge portion having the concave-convex tooth portions and is located on a surface opposite to the concave-convex tooth portions.

6. The one-piece formed metal heat dissipation plate according to claim 1, wherein materials of the substrate and each heat dissipation strip comprise aluminum or aluminum alloy, and each of the concave-convex tooth portions is triangular, rectangular, arc-shaped, or a combination thereof.

7. The one-piece formed metal heat dissipation plate according to claim 1, wherein the substrate further comprises two frame stripes disposed opposite to each other, and the heat dissipation fins are arranged on the two frame stripes and/or at least one of the ridge portions.

8. The one-piece formed metal heat dissipation plate according to claim 1, further comprising a plurality of assembly portions arranged on the substrate, wherein a heat pipe is assembled to the assembly portions of the substrate.

* * * * *